US009627758B2

(12) United States Patent
Hung

(10) Patent No.: US 9,627,758 B2
(45) Date of Patent: Apr. 18, 2017

(54) MULTIBAND ANTENNA

(71) Applicant: HON HAI PRECISION INDUSTRY CO., LTD., New Taipei (TW)

(72) Inventor: Chih-Ming Hung, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/692,364

(22) Filed: Apr. 21, 2015

(65) Prior Publication Data

US 2016/0079667 A1 Mar. 17, 2016

(30) Foreign Application Priority Data

Sep. 17, 2014 (TW) ..... 103132025 A

(51) Int. Cl.
*H01Q 1/48* (2006.01)
*H01Q 5/371* (2015.01)
*H01Q 9/40* (2006.01)

(52) U.S. Cl.
CPC ..... *H01Q 5/371* (2015.01); *H01Q 9/40* (2013.01)

(58) Field of Classification Search
CPC H01Q 5/371; H01Q 1/48; H01Q 1/38; H01Q 9/40
USPC ..... 343/700 MS
See application file for complete search history.

(56) References Cited

U.S. PATENT DOCUMENTS 7,030,830 B2 * 4/2006 Azoulay ..... H01Q 9/16 343/702
2013/0234895 A1 * 9/2013 Peng ..... H01Q 9/285 343/700 MS

FOREIGN PATENT DOCUMENTS

| | | | |
|---|---|---|---|
| CN | 2727986 | Y | 9/2005 |
| CN | 101582535 | A | 11/2009 |
| CN | 102088133 | A | 6/2011 |
| CN | 203596410 | U | 5/2014 |
| TW | M330584 | | 4/2008 |

* cited by examiner

*Primary Examiner* — Dieu H Duong
(74) *Attorney, Agent, or Firm* — Zhigang Ma

(57) ABSTRACT

A multiband antenna includes a radiating portion and a ground portion. The radiating portion includes a first radiating section, a second radiating section and a coupling section. The coupling section is coupled between the first radiating section and the second radiating section. The ground portion includes a first ground section, a second ground section and a third ground section. The second ground section and the third ground section both coupled to a first side of the first ground section. The coupling section and the second radiating section are accommodated in a surrounded area defined inside the first ground section, the second ground section and the third ground section, and the first radiating section extend outside the surrounded area.

15 Claims, 5 Drawing Sheets

MULTIBAND ANTENNA

FIELD

The subject matter herein generally relates to antennas, more particularly to a multiband antenna.

BACKGROUND

Demands for mobile communication products are increasing. Many communication products are miniaturized portable products requiring small high performance components. Currently, microstrip antennas are widely used in broadband communication applications. Isolation is low between microstrip antennas, which are near to each other.

BRIEF DESCRIPTION OF THE DRAWINGS

Implementations of the present technology will now be described, by way of example only, with reference to the attached figures.

DETAILED DESCRIPTION

Figure 1:
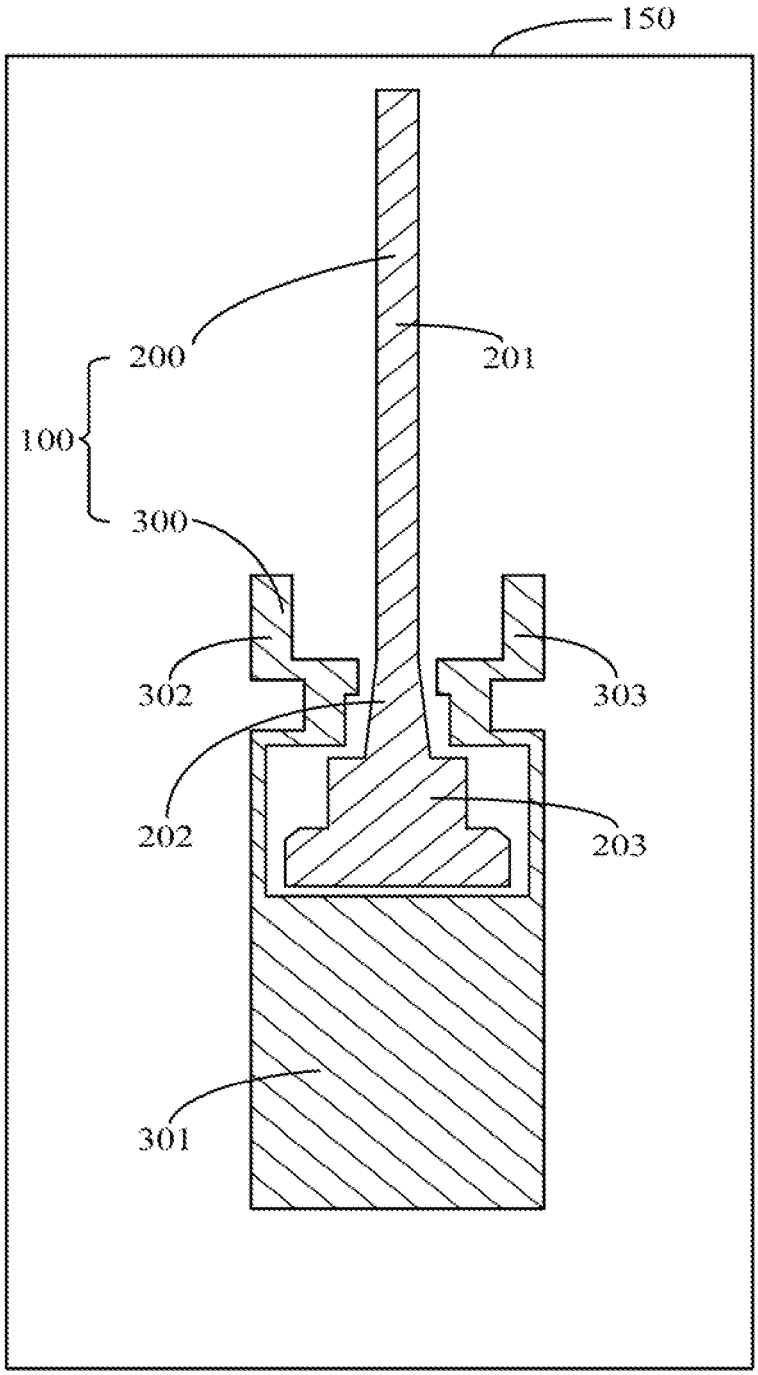
FIG. 1 illustrates a diagrammatic view of a first embodiment of a multiband antenna.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The term "comprising" when utilized, means "including, but not necessarily limited to", it specifically indicates open-ended inclusion or membership in the so-described combination, group, series and the like.

The present disclosure is described in relation to a multiband antenna 100.

FIG. 1 illustrates a diagrammatic view of a first embodiment of a multiband antenna 100. The multiband antenna 100 is printed on a base board 150. The multiband antenna 100 includes a radiating portion 200 and a ground portion 300. The radiating portion 200 is configured to transceive radio frequency (RF) signals. The ground portion 300 is configured to connect to ground. In at least one embodiment, the radiating portion 200 and the ground portion 300 are located in different areas of the base board 150. Thus RF signals in the radiating portion 200 and RF signals in the ground portion 300 can be coupled together.

The radiating portion 200 includes a first radiating section 201, a coupling section 202 and a second radiating section 203. The ground portion 300 includes a first ground section 301, a second ground section 302 and a third ground section 303. The first radiating section 201 is connected to the second radiating section 203 through the coupling section 202. The second ground section 302 and the third ground section 303 are both connected to first side of the first ground section 301. A surrounded area is defined inside the first ground section 301, the second ground section 302 and the third ground section 303. The coupling section 202 and the second radiating section 203 are accommodated in the surrounded area. The first radiating section 201 extends outside the surrounded area. That is, the first radiating section 201 is partly accommodated in the surrounded area and is partly extended outside the surrounded area. Thus, the ground portion 300 is coupled to the coupling section for increasing bandwidth of the multiband antenna 100.

The coupling section 202 and the ground portion 300 form a coupling structure so that RF signals in the coupling section 202 and RF signals in the ground portion 300 can be coupled together. Thus, the multiband antenna 100 can have an expansive working frequency band.

Figure 2:
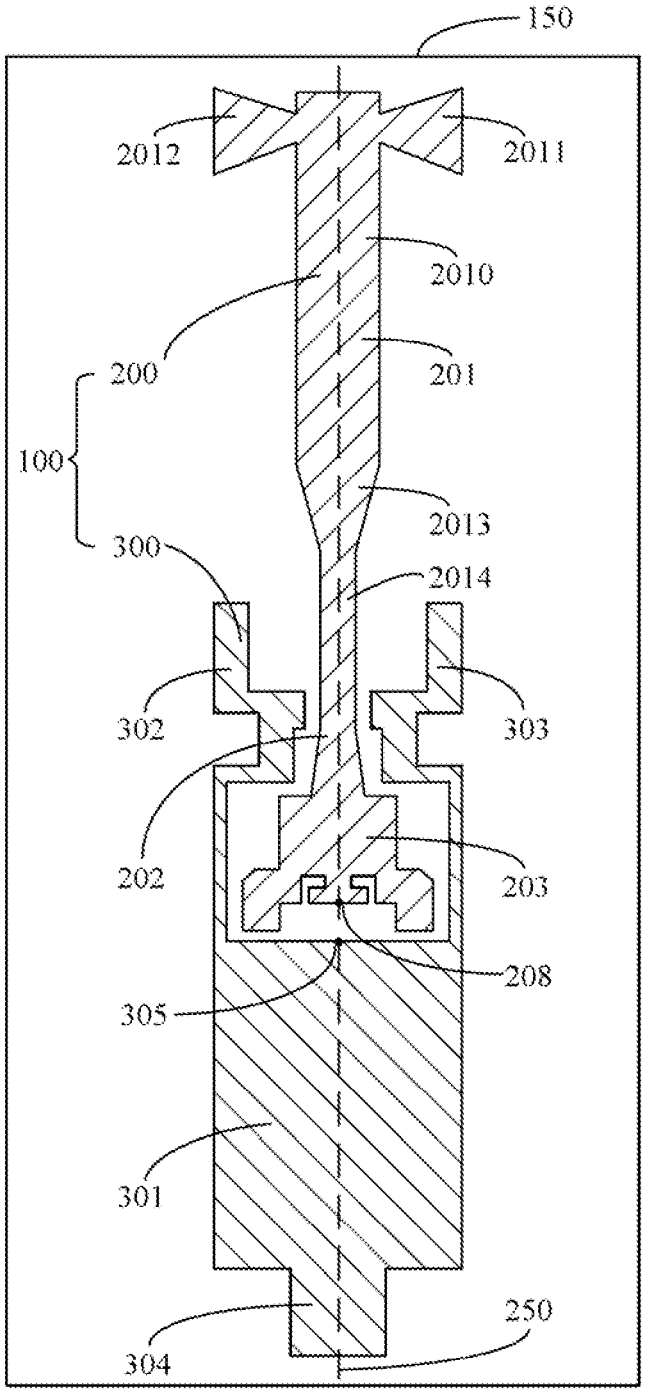
FIG. 2 illustrates a diagrammatic view of a second embodiment of a multiband antenna.

FIG. 2 illustrates a diagrammatic view of a second embodiment of a multiband antenna 100. In the second embodiment, the multiband antenna 100 is a further improvement of the first embodiment. The first radiating section 201 further includes a first connecting section 2010, a second connecting section 2011, a third connecting section 2012, a narrow section 2013 and a fourth connecting section 2014.

The first connecting section 2010 is strip-shaped. The second connecting section 2011 and the third connecting section 2012 are both trapezoid-shaped. In order to adjust a first working frequency band, a shorter parallel side of the second connecting section 2011 and a shorter parallel side of the third connecting section 2012 are connected to opposite sides of the first connecting section 2010 symmetrically. In the second embodiment, the first working frequency band is from 791 megahertz to 862 megahertz.

The first connecting section 2010 is connected to the fourth connecting section 2014 through the narrow section 2013. The fourth connecting section 2014 is strip-shaped. An edge of the narrow section 2013 connected to the first connecting section 2010 has same width as the first connecting section 2010. Another edge of the narrow section 2013 connected to the fourth connecting section 2014 has same width as the fourth connecting section 2014. The edge of the narrow section 2013 connected to the first connecting section 2010 is wider than the edge of the narrow section 2013 connected to the fourth connecting section 2014. According to the different working frequency bands of an antenna requirement, lengths of the first connecting section 2010, the narrow section 2013 and the fourth connecting section 2014 can be adjusted to match impedance of a second working frequency band. In at least one embodiment, the second working frequency band is from 1710 megahertz to 1880 megahertz. In other embodiments, the first connecting section 2010, the narrow section 2013 and the fourth connecting section 2014 can be other shapes.

The fourth connecting section 2014 is connected to the second radiating section 203 through the coupling section 202. An edge of the coupling section 202 connected to the fourth connecting section 2014 has same width as the fourth connecting section 2014. In the second embodiment, widths of the coupling section 202 and the second radiating section 203 become wider gradually in a direction away from the coupling section 202 toward the second radiating section 203.

A top of the second radiating section 203 is connected to a bottom of the coupling section 202. A rectangle slot is defined in a middle of a bottom of the second radiating section 203. In order to adjust a third working frequency band, the second radiating section 203 further defines two symmetric slots symmetrical with a central axis 250 of the multiband antenna 100. In the embodiment, the two symmetric slots are inverted L-shapes. A feed point 208 is defined in a node of the central axis 250 and the bottom of the second radiating section 203, so that RF signals are symmetrical about the central axis 250. In at least one embodiment, the third working frequency band is from 2500 megahertz to 2690 megahertz. In other embodiments, the two slots can be other shapes, such as circular.

In the ground portion 300, the second ground section 302 and the third ground section 303 are both connected to the first side of the first ground section 301. In at least one embodiment, the first ground section 301 is square-shaped. A terminal of the second ground section 302 and a terminal of the third ground section 303 are connected to two adjacent vertexes of the first ground section 301 respectively. The ground portion 300 further includes a fourth ground section 304 connected to a second side of the first ground section 301. The second ground section 302 and the third ground section 303 are symmetric about the central axis 250 of the multiband antenna 100. Thus, the fourth connecting section 2014, the coupling section 202 and the second radiating section 203 are surrounded by the ground portion 300.

Furthermore, the second ground section 302 is extended towards the coupling section 202 to reduce a distance between the second ground section 302 and the coupling section 202. The third ground section 303 is extended towards the coupling section 202 to reduce a distance between the third ground section 303 and the coupling section 202. As a result, the multiband antenna 100 can have an expansive working frequency band. A ground point 305 is defined in a node of the central axis 250 and the top of the first ground section 301.

Figure 3:
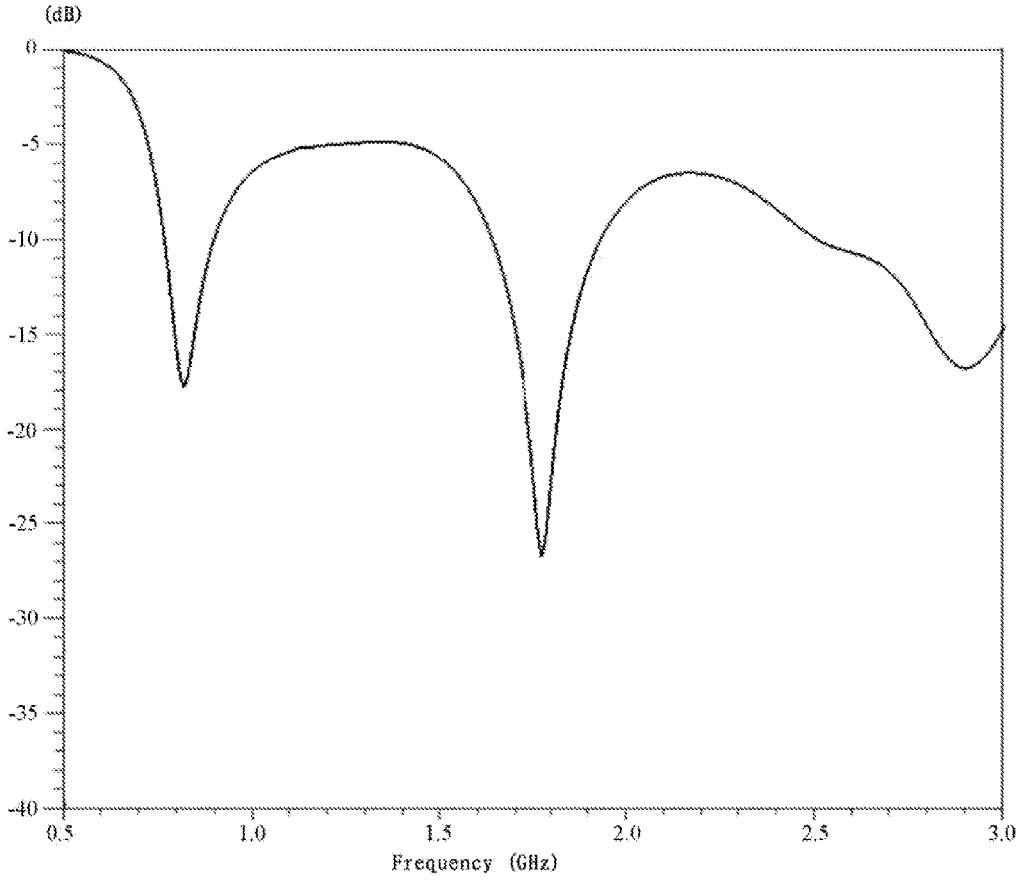
FIG. 3 illustrates a return loss diagram of the second embodiment of the multiband antenna.

FIG. 3 illustrates a return loss diagram of the second embodiment of the multiband antenna 100. Return loss of the working frequency bands are below minus 10 decibels. As shown in FIG. 3, three working frequency bands in the multiband antenna 100 are able to meet LTE standards.

Figure 4:
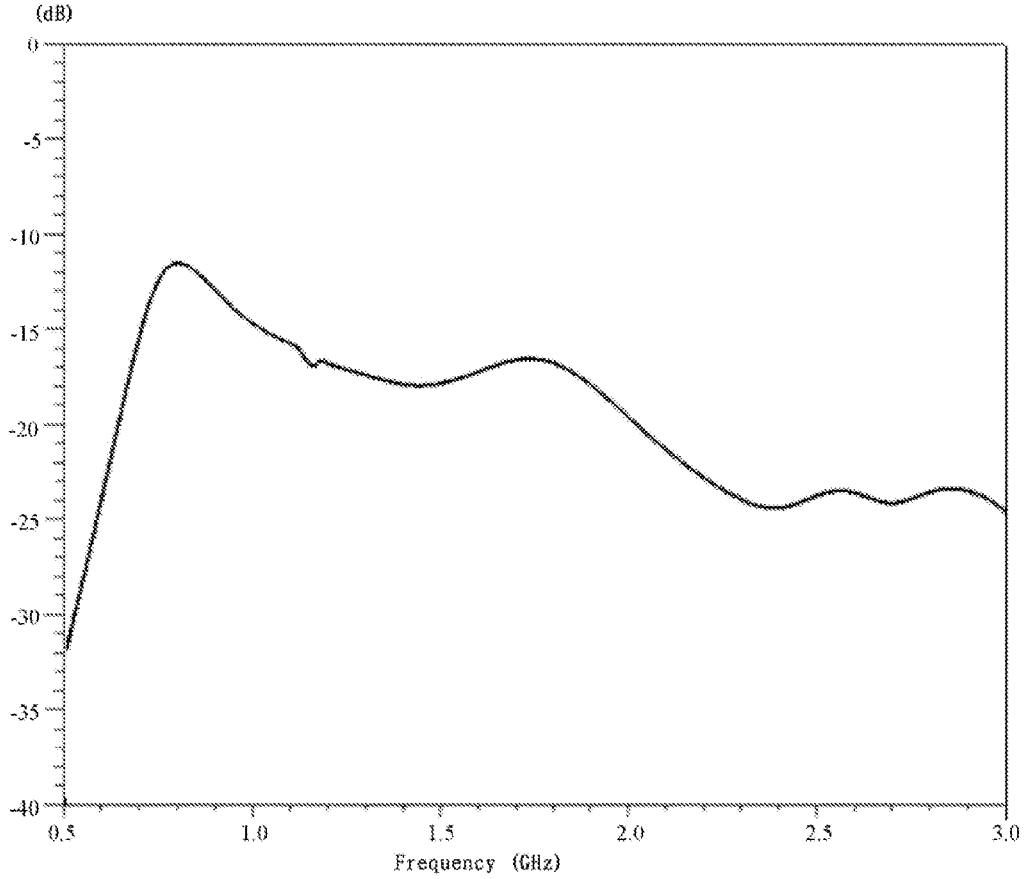
FIG. 4 illustrates an isolation measurement diagram of two multiband antennas in a distance of 120 millimeters.
Figure 5:
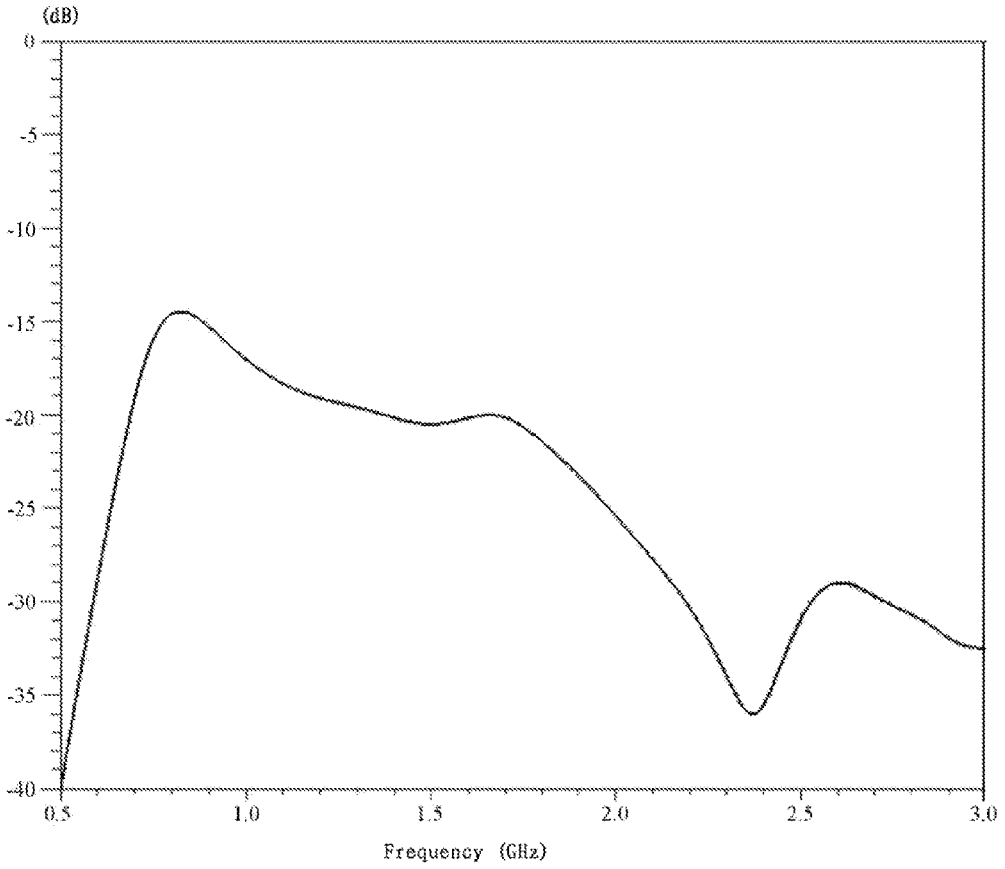
FIG. 5 illustrates an isolation measurement diagram of two multiband antennas in a distance of 180 millimeters.

FIG. 4 illustrates an isolation measurement diagram of two multiband antennas 100 in a distance of 120 millimeters. FIG. 5 illustrates an isolation measurement diagram of two multiband antennas 100 in a distance of 180 millimeters. The shorter the distance between the multiband antennas 100, the better isolation of the multiband antennas 100 as shown as curves in the diagrams. That is, the multiband antenna 100 has a good performance of isolation to be applied in Multiple Input Multiple Output (MIMO) systems.

Many details are often found in the art such as the other features of the multiband antenna. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A multiband antenna, comprising:

a radiating portion, configured to transceive RF signals, comprising:

a first radiating section;

a second radiating section; and a coupling section, coupling the first radiating section and the second radiating section; and a ground portion, coupled to the coupling section, the coupling section and the ground portion increasing a bandwidth of the multiband antenna, the ground portion comprising:

a first ground section;

a second ground section, connected to a first side of the first ground section; and a third ground section, connected to the first side of the first ground section;

wherein the second ground section and the third ground section are symmetric about a central axis of the multiband antenna, the first ground section, the second ground section, and the third ground section collectively define a surrounded area, the coupling section and the second radiating section are accommodated in the surrounded area, and the first radiating section is partly accommodated in the surrounded area and partly extends outside the surrounded area;

wherein the first radiating section comprises a first connecting section, a second connecting section and a third connecting section, the second connecting section and the third connecting section are connected in opposite sides of the first connecting section symmetrically.

2. The multiband antenna as claimed in claim 1, wherein the first connecting section is strip-shaped, and the second connecting section and the third connecting section are both trapezoid-shaped.

3. The multiband antenna as claimed in claim 2, wherein a shorter parallel side of the second connecting section and a shorter parallel side of the third connecting section are coupled in opposite sides of the first connecting section symmetrically.

4. The multiband antenna as claimed in claim 1, wherein the first radiating section further comprises a fourth connecting section connected to the second radiating section via the coupling section.

5. The multiband antenna as claimed in claim 4, wherein an edge of the coupling section coupled to the fourth connecting section has same width as the fourth connecting section.

6. The multiband antenna as claimed in claim 4, wherein the first radiating section comprises a narrow section, wherein an edge of the narrow section coupled to the first connecting section is wider than an edge of the narrow section coupled to the fourth connecting section.

7. The multiband antenna as claimed in claim 6, wherein the edge of the narrow section coupled to the first connecting section has same width as the first connecting section, and another edge of the narrow section coupled to the fourth connecting section has same width as the fourth connecting section.

8. The multiband antenna as claimed in claim 1, wherein the second ground section is extended towards the coupling section to reduce a distance between the second ground section and the coupling section, and the third ground section is extended towards the coupling section to reduce a distance between the third ground section and the coupling section.

9. The multiband antenna as claimed in claim 1, wherein the coupling section and the second radiating section become wider gradually in a direction away from the coupling section towards the second radiating section.

10. The multiband antenna as claimed in claim 1, wherein the second radiating section defines at least a slot.

11. The multiband antenna as claimed in claim 10, wherein the slot is rectangle-shaped.

12. The multiband antenna as claimed in claim 1, wherein the second radiating section defines two symmetric slots symmetrically with the central axis of the multiband antenna.

13. The multiband antenna as claimed in claim 12, wherein the two symmetric slots are inverted L-shaped.

14. A multiband antenna, comprising:

a radiating portion, configured to transceive RF signals, comprising:

a first radiating section;

a second radiating section, wherein the second radiating section defines at least a slot; and a coupling section, coupling the first radiating section and the second radiating section; and a ground portion, coupled to the coupling section, the coupling section and the ground portion increasing a bandwidth of the multiband antenna, the ground portion comprising:

a first ground section;

a second ground section, connected to a first side of the first ground section; and a third ground section, connected to the first side of the first ground section;

wherein the first ground section, the second ground section, and the third ground section collectively define a surrounded area, the coupling section and the second radiating section are accommodated in the surrounded area, and the first radiating section is partly accommodated in the surrounded area and partly extends outside the surrounded area.

15. A multiband antenna, comprising:

a radiating portion, configured to transceive RF signals, comprising:

a first radiating section;

a second radiating section, wherein the second radiating section defines two symmetric slots symmetrically with a central axis of the multiband antenna; and a coupling section, coupling the first radiating section and the second radiating section; and a ground portion, coupled to the coupling section, the coupling section and the ground portion increasing a bandwidth of the multiband antenna, the ground portion comprising:

a first ground section;

a second ground section, connected to a first side of the first ground section; and a third ground section, connected to the first side of the first ground section;

wherein the first ground section, the second ground section, and the third ground section collectively define a surrounded area, the coupling section and the second radiating section are accommodated in the surrounded area, and the first radiating section is partly accommodated in the surrounded area and partly extends outside the surrounded area.

* * * * *